US008366156B2

(12) United States Patent
Mercier et al.

(10) Patent No.: US 8,366,156 B2
(45) Date of Patent: Feb. 5, 2013

(54) CART WITH FLEXIBLE LATCH

(75) Inventors: Louis Mercier, Levis (CA); Roch Nolet, St-Joseph (CA); Philippe Noel, Breakeyville (CA); Marc Talbot-Pouliot, Saint-Lazare-De-Bellechasse (CA)

(73) Assignee: IPL, Inc., Quebec (CA)

( * ) Notice: Subject to any disclaimer, the term of this patent is extended or adjusted under 35 U.S.C. 154(b) by 93 days.

(21) Appl. No.: 12/886,094

(22) Filed: Sep. 20, 2010

(65) Prior Publication Data

US 2011/0272953 A1 Nov. 10, 2011

Related U.S. Application Data

(63) Continuation-in-part of application No. 29/361,333, filed on May 10, 2010, now Pat. No. Des. 657,106.

(51) Int. Cl.
*E05C 19/06* (2006.01)
*E05C 19/00* (2006.01)

(52) U.S. Cl. ..... 292/80; 292/81; 292/85; 292/195; 292/303

(58) Field of Classification Search ..... 292/80, 292/81, 85, 87, 89, 303, 195
See application file for complete search history.

(56) References Cited

U.S. PATENT DOCUMENTS

| | | | | | |
|---|---|---|---|---|---|
| 392,224 | A | * | 11/1888 | Reece | 292/87 |
| 1,888,699 | A | | 11/1932 | Schwarz | |
| 2,358,607 | A | * | 9/1944 | Tinnerman | 292/87 |
| 2,402,939 | A | * | 7/1946 | Auslander et al. | 292/103 |
| 2,756,084 | A | * | 7/1956 | Fraser | 292/87 |
| 3,334,770 | A | * | 8/1967 | Stanback | 220/326 |
| 4,270,668 | A | * | 6/1981 | Berfield | 220/324 |
| 5,720,589 | A | | 2/1998 | Christenson et al. | |
| 5,738,390 | A | | 4/1998 | Yemini | |
| 6,378,918 | B1 | * | 4/2002 | Mita et al. | 292/103 |
| 6,561,554 | B2 | * | 5/2003 | Colbert et al. | 292/87 |
| 6,571,740 | B1 | * | 6/2003 | Kinder et al. | 119/497 |
| 7,048,464 | B2 | * | 5/2006 | Ronnquist | 403/321 |
| 7,121,564 | B2 | | 10/2006 | Hassell | |
| 7,287,665 | B2 | | 10/2007 | Meissen et al. | |
| 2003/0001394 | A1 | * | 1/2003 | Colbert et al. | 292/87 |
| 2004/0222231 | A1 | | 11/2004 | Aiken et al. | |
| 2010/0090428 | A1 | | 4/2010 | Meers et al. | |

FOREIGN PATENT DOCUMENTS

| | | | |
|---|---|---|---|
| WO | WO-94/22747 | A1 | 10/1994 |
| WO | WO-2006043042 | A1 | 4/2006 |

OTHER PUBLICATIONS

Office Action issued in Canadian counterpart Application No. 2,735,386.

Norseman Environmental Products, Green Bin Container, Retrieved from http://www.norsemanplastics/com/products/norseman_greenbin_npl_280.html, Sep. 2009; 1 page.

Rehrig, Trash Bin, Document provided to Village of Gatimeau for bidding purposes, Sep. 2009, 1 page. EP Search Report of EP Application No. 11177608.4.

* cited by examiner

*Primary Examiner* — Carlos Lugo
(74) *Attorney, Agent, or Firm* — Edwards Wildman Palmer LLP; Howard M Gitten

(57) ABSTRACT

A cart has a container body and a lid rotatably affixed to the container body so as to be selectively rotated between an open position and a closed position. A latch has a first end adapted to be rotatably affixed to the lid. A second end is adapted to engage the container body. The first end is connected to the second end by an arched member, the arched member is capable of flexure when a force is applied at a concave surface of the arched member.

10 Claims, 7 Drawing Sheets

CART WITH FLEXIBLE LATCH

CROSS-REFERENCE TO RELATED APPLICATION

This application is a Continuation-In-Part of U.S. application Ser. No. 29/361,333 filed on May 10, 2010 in its entirety.

BACKGROUND OF THE INVENTION

The present invention is directed to a latch for closing a cart lid to a cart, and in particular, to a plastic latch mounted on a cart.

Carts such as garbage carts for homes are known in the art. The carts have a container body. In some embodiments, wheels may be provided at a lower corner of the container body. A lid is rotatably affixed to the container to rotate between a first open position and a second closed position.

To prevent animals from gaining access to trash carts or prevent inadvertent spilling of the contents, it becomes necessary to lock the lid in the closed position. As is known in the art, latches are provided. These latches are usually metal pieces. In products such as those manufactured by Rehrig or Norseman, a metal piece formed as a rod is pivotally mounted to the lid. The rod forms a general U-shape in which a first end of the rod is mounted to the lid and the second opposed end of the wire is also mounted to an opposed position on the lid so that the U-shaped rod is pivotally mounted to the lid. The base of the U may be formed as a handle. The sections between the handle and the respective rod ends form, at least in part, an engaging portion for engaging a lip of the container body. In this way, as the latch is pivoted about its ends from a first open position to a second closed position, engaging portions of the latch engage a portion of the container body locking the lid against the container body. To release the lid, the handle is pulled to rotate the latch from the second position releasing the lid from the container body allowing the lid to be rotated into an open position.

BRIEF SUMMARY OF THE INVENTION

A cart has a container body and a lid rotatably affixed to the container body so as to be selectively rotated between a first open position and a second closed position. A latch has a first end adapted to be rotatably affixed to the lid. A second end is adapted to engage the container body. The first end is connected to the second end by an arched member, the arched member capable of flexure when a force is applied at a concave surface of the arched member.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

Figure 1:
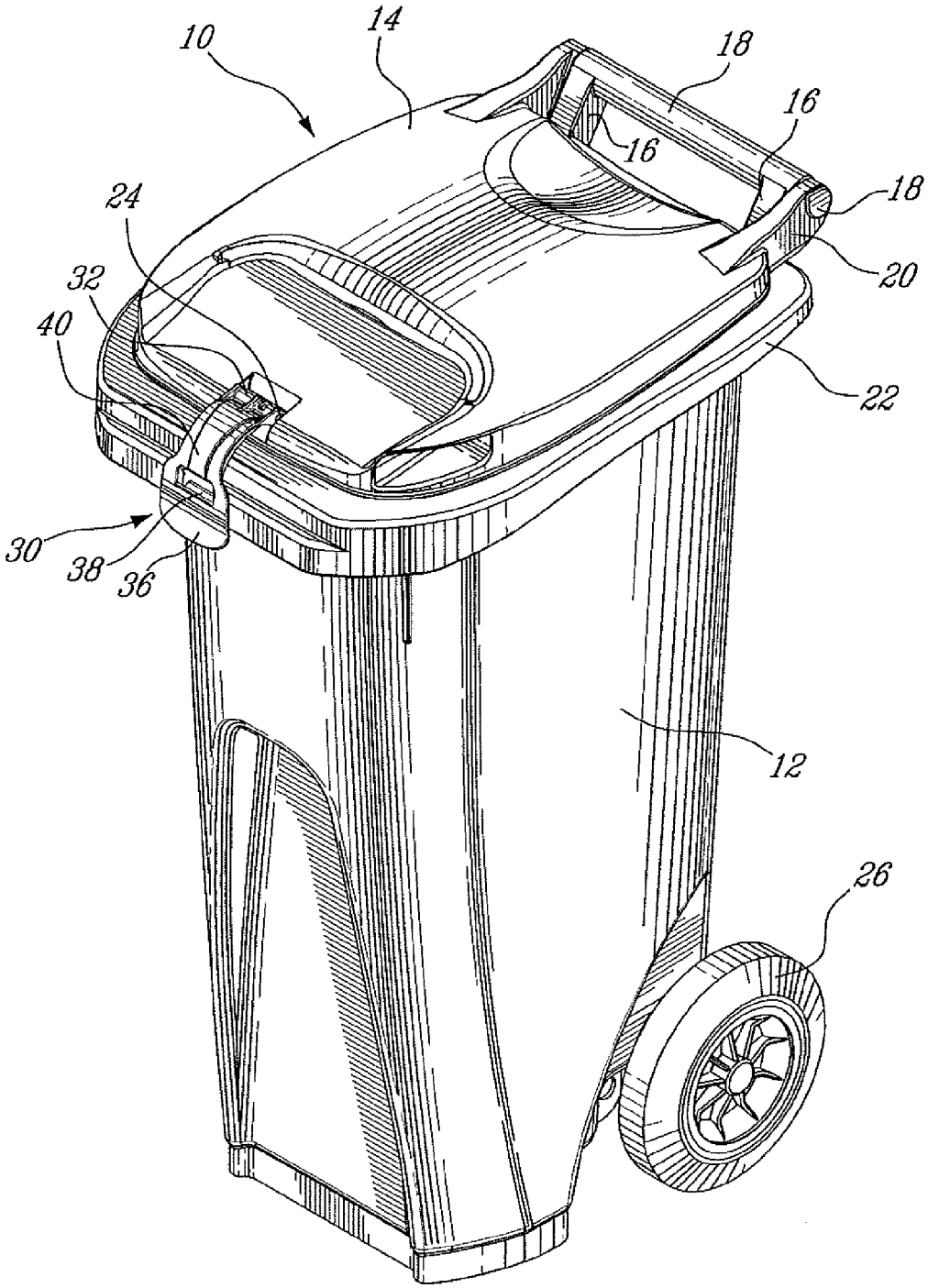
FIG. 1 is a perspective view of a cart constructed in accordance with the invention.
Figure 2:
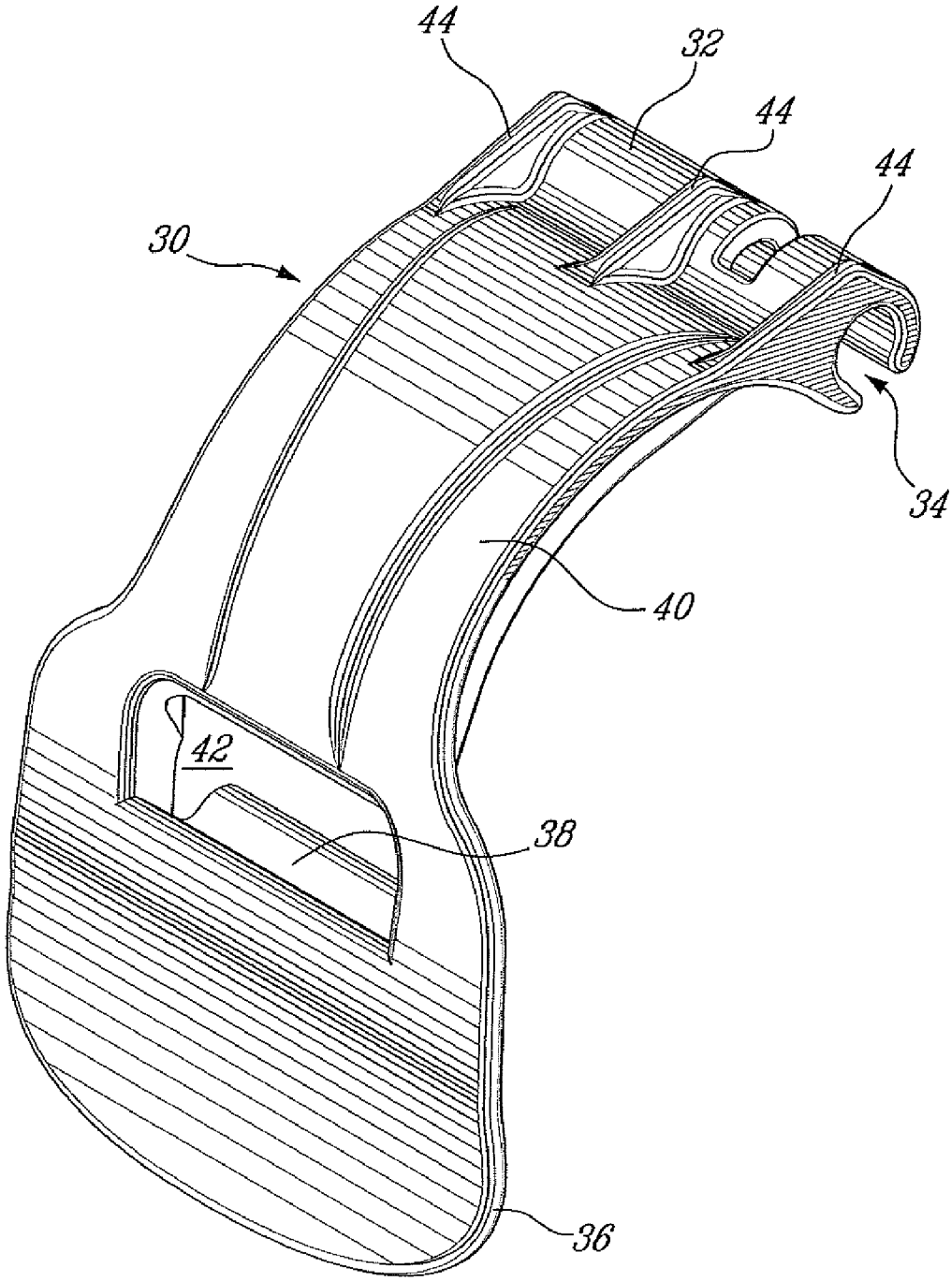
FIG. 2 is a perspective view of a latch constructed in accordance with the invention.
Figure 3:
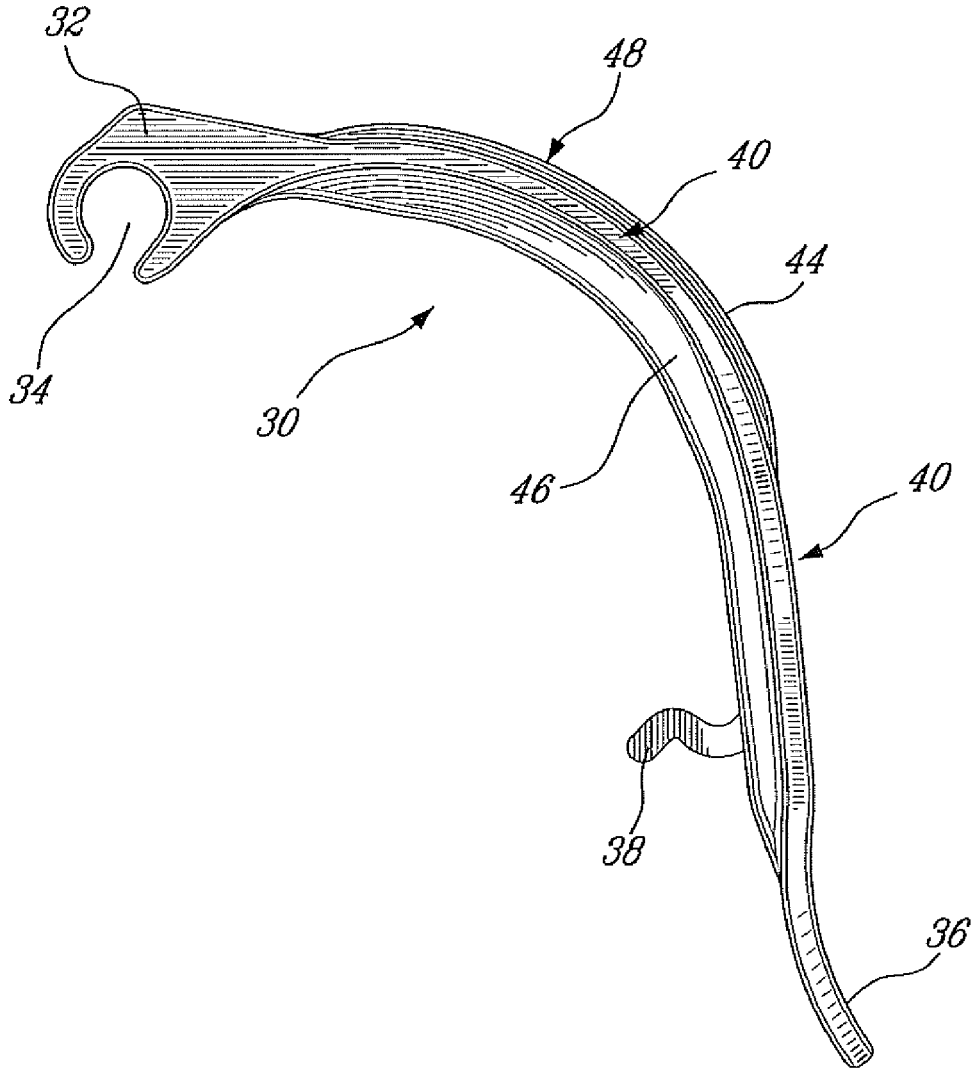
FIG. 3 is a side elevation view of a latch constructed in accordance with the invention.
Figure 5:
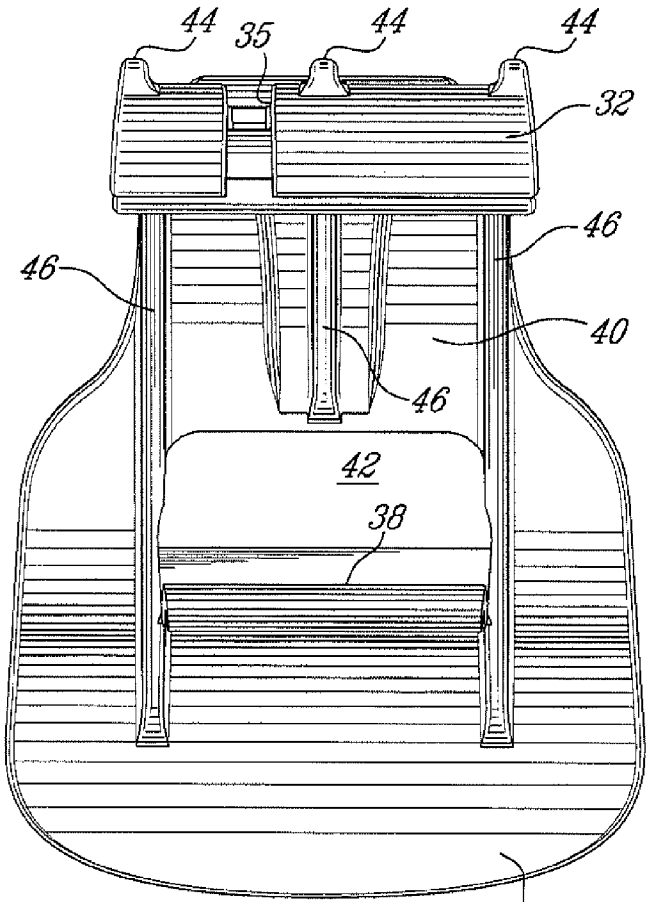
FIG. 5 is a rear elevation view of a latch constructed in accordance with the invention.
Figure 4:
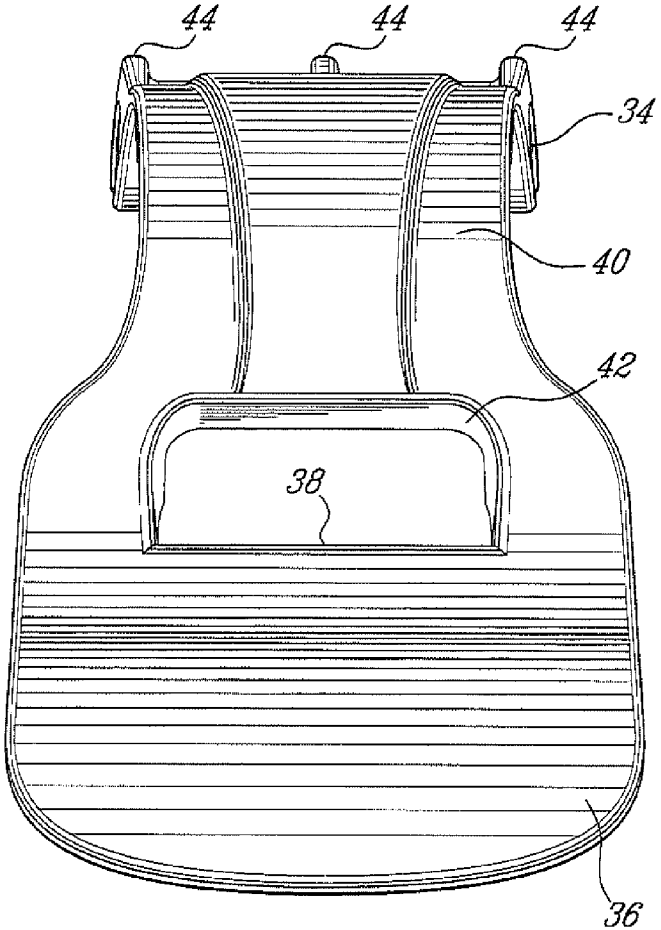
FIG. 4 is a front elevation view of a latch constructed in accordance with the invention.
Figure 7:
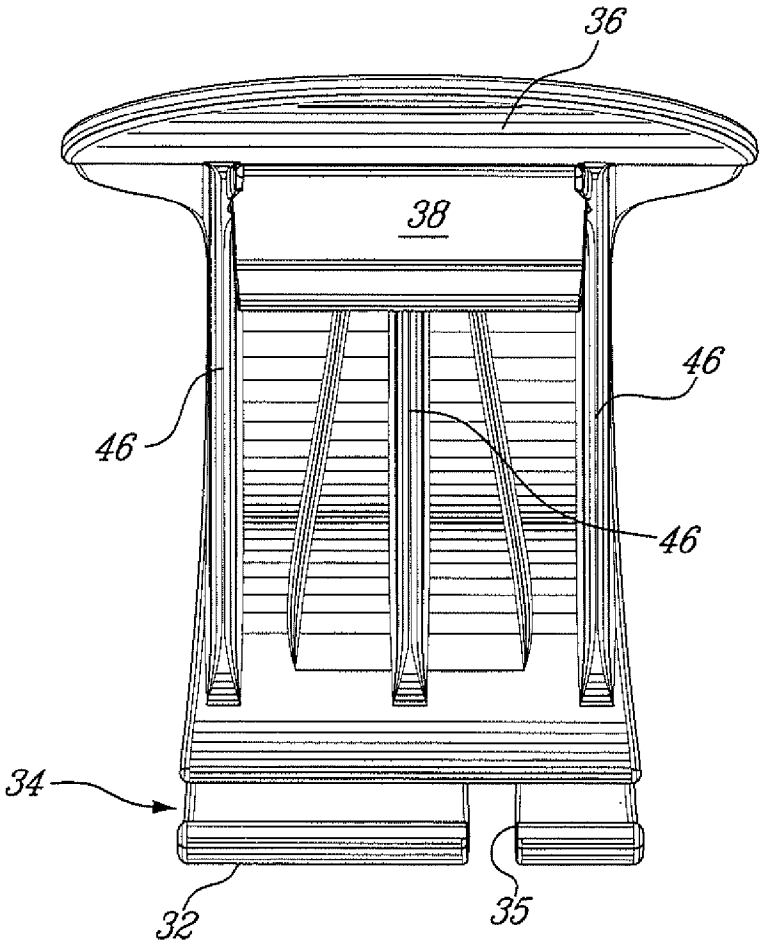
FIG. 7 is a bottom plan view of a latch constructed in accordance with the invention.
Figure 6:
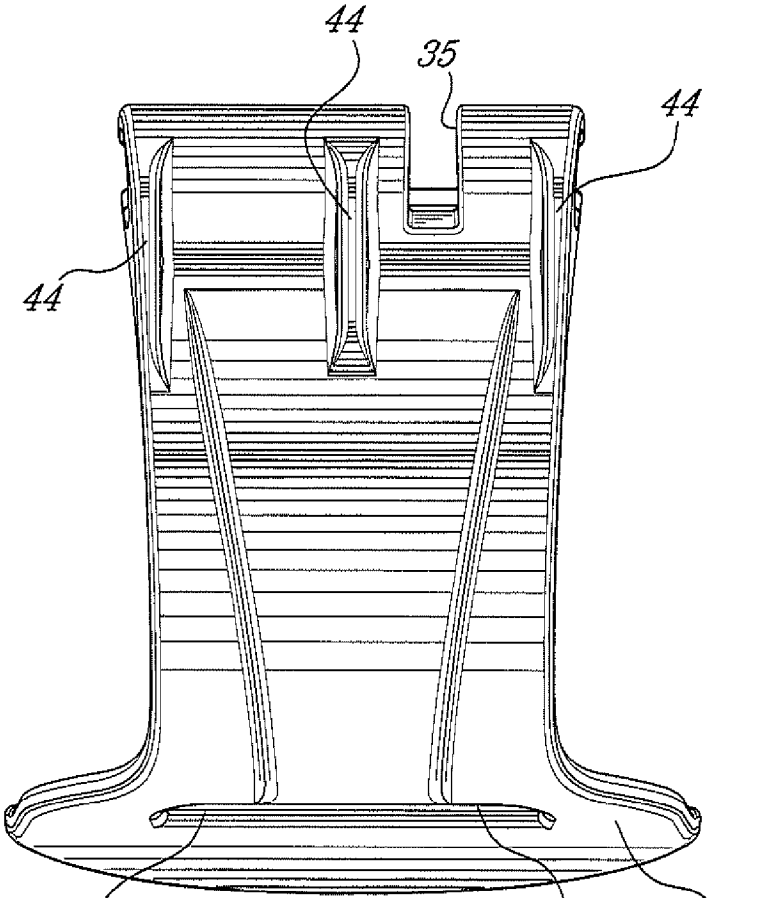
FIG. 6 is a top plan view of a latch constructed in accordance with the invention.
Figure 8:
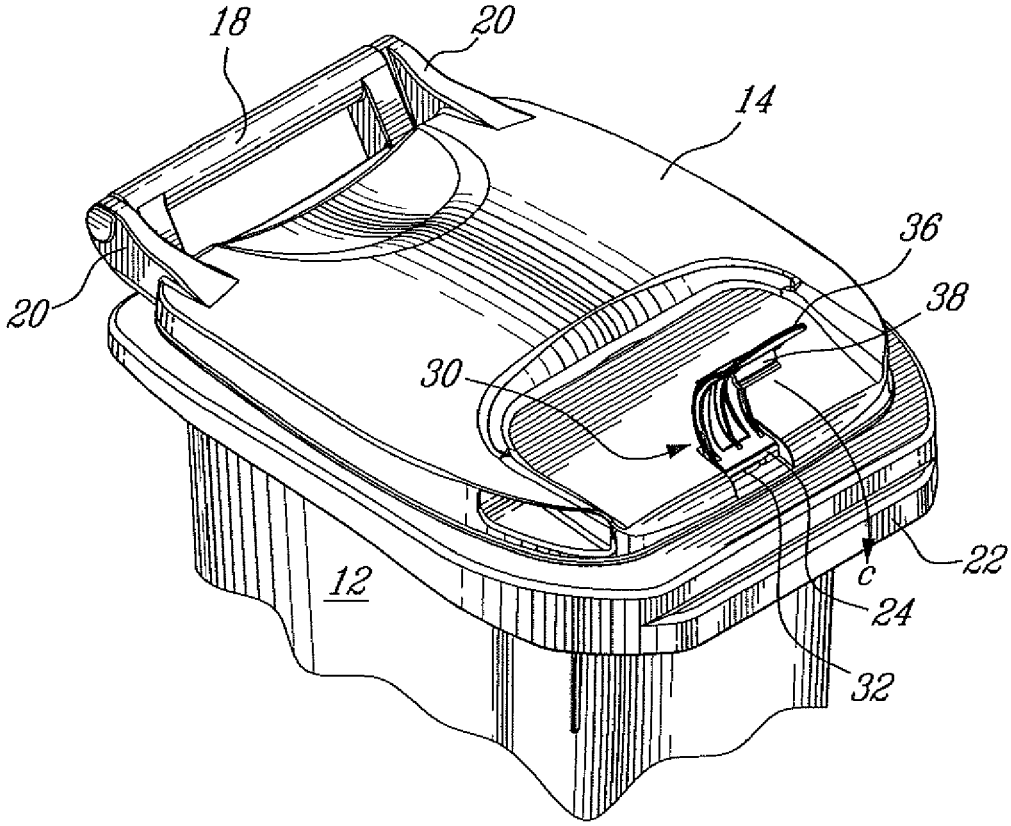
FIG. 8 is a perspective view of the cart showing the latch in an open position.
Figure 10:
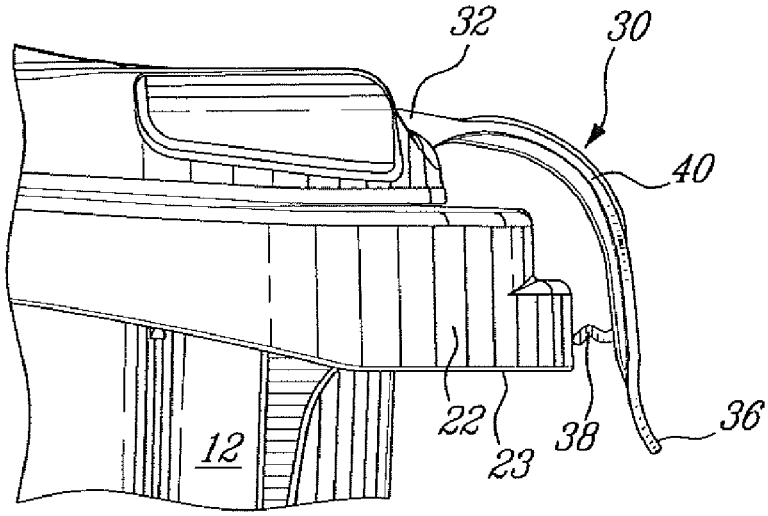
FIG. 10 is a side elevation view of the cart showing the latch in an intermediate position in accordance with the invention.

Reference is generally made to FIGS. 1, 8, and 10 in which a cart, generally indicated as 10, constructed in accordance with the invention is provided. Cart 10 includes a container body 12 having a projection in the form of an upper rim 22 extending about a top, and the opening formed at the top of body 12. Support members 16 extend from the rim 22. A handle 18 is supported by support members 16 spaced away from housing 12.

Wheels 26 are affixed to housing 12 as in a manner known in the art so that cart 10 is mobile.

As will be seen below, rim 22 is provided by way of exemplary, but nonlimiting embodiment. Any projection from body 12 is contemplated by the present invention. Rim 22 may merely be a ridge, a lip, a platform, or a projection capable of being engaged by a latch 30. Support member 16 may also extend from body 12, rather than rim 22.

A lid 14 sized to cover an opening (not shown) of body 12 is rotatably disposed on body 12. Lid 14 is formed with wings 20 for rotatably engaging handle 18 as known in the art. In this manner, lid 14 may be moved from a first closed position, as seen in the figures, about the pivot provided by handle 18 to an open position (not shown) to allow access to the cart body 12. A pivot 24 is formed within lid 14. In a preferred, nonlimiting embodiment, pivot 24 is at an edge of lid 14 opposed to an edge from which lid 14 is rotatably affixed to body 12.

Figure 9:
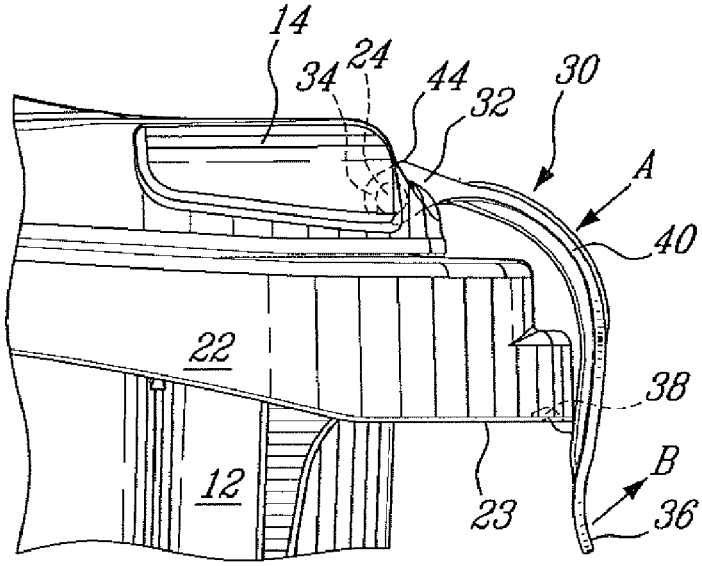
FIG. 9 is a side elevation view of the cart showing the latch in the closed position in accordance with the invention.

Latch 30 is pivotally disposed about pivot 24 and is adapted to engage a projection such as that formed by rim 22 to lock lid 14 in the closed position. Accordingly, latch 30 is rotatable between a first open position, as shown in FIG. 8, which allows rotation of lid 14 and a closed position, as shown in FIG. 9, which locks the lid 14 to body 12 in the closed position.

Reference is now also made to FIGS. 2-7 in which latch 30 is shown with greater particularity. Latch 30 includes a first member 32 which is a pivot member. First member 32 is formed with a receiving portion, in an exemplary but nonlimiting embodiment, an opening 34 therein, adapted to receive pivot 24 of lid 14. Latch 30 includes a second member 36 acting as a handle. An arch member 40 connects first member 32 with second member 36. Handle portion 36 is formed with a catch 38. Catch 38 is a projection adapted to engage a projection of housing body 12 such as rim 22.

In a preferred nonlimiting embodiment, pivot member 32, handle 36, and arch member 40 are formed as a unitary construction; preferably formed of a plastic material. Arch member 40 is flexible such that a force applied at a convex surface 48 of latch 30 will deflect arch member 40 flattening arch member 40 to lengthen latch 30. Arch 40 has sufficient resiliency that it will substantially return to its original shape upon removal of the force at convex surface 48 of arch portion 40.

In a preferred but nonlimiting embodiment, to reduce the amount of material required for latch 30, without sacrificing strength, flexibility, and resiliency, various structures are incorporated into latch 30. A plurality of support archs 44 extend along convex surface 48 between arch member 40 and pivot member 32. Additionally, a second set of support members 46 comprised of one or more support archs, in a nonlimiting exemplary embodiment, extend along a concave surface of arched member 40, and may extend from the handle portion of second member 36 to the pivot portion of second member 32. An opening 42 may be provided in second member 36 adjacent catch 38. Catch 38 may be any shape capable of engaging a projection from housing 12, such as rim 22 while also being dimensioned to allow for disengagement by flexure of handle 36 as will be discussed below.

During use, latch 30 is pivotally mounted to lid 14. Pivot 24 is received within opening 34 of pivot 32 of latch 30. To lock cart 10, latch 30 is pivoted from a first open position (FIG. 8) in a direction of arrow C to an intermediate position (FIG. 10).

In the intermediate position, it becomes apparent that latch 30 is dimensioned so that catch 38 is positioned along latch 30 so that when no force is applied to latch 30, catch 38 is disposed at a position in which it does not engage rim 22, in this instance the position is above a bottom surface 23 of the projection provided by rim 22. However, as seen in FIG. 9, when a force is applied to the convex surface 48 of arched member 40, latch 30 is lengthened so that catch 38 moves below bottom surface 23 of rim 22 to engage rim 22. Latch 30 is resilient such that once the force in the direction of arrow A is removed, latch 30 will substantially return to its original position. However, catch 38 engaging rim 22 prevents complete return, and therefore the restorative force of latch 30 keeps latch 30 in the closed position by the force applied by catch 38 against lip 22. It should be noted that a force in the direction of arrow A not only extends the length of latch 30, but also continues to move handle 30 in the direction of arrow C so that it is the action of pressing against latch 30 at arch member 40 which closes and locks the cart as shown in FIGS. 1 and 9.

To open the cart, it should be noted that handle portion 36 is slightly curved in that portion of second member 36, which extends from catch 38. Handle 36 is curved in a direction opposed to the curve of arch member 40, and in a preferred embodiment, to a lesser extent (more obtuse curve) than the curve of arched member 40. This facilitates applying a force in direction of arrow B to latch 30 at handle portion 36. Applying a force at handle portion 36 pulls catch 38 away from rim 22 releasing latch 30 allowing rotation into the open position shown in FIG. 8. It should be known that the surface of catch 38 may be rounded or cammed to allow catch 38 to slide along rim 22 as it is released rather than requiring movement of handle portion 36 sufficient to rotate catch 38 to clear rim 22 or to flatten catch 40.

In a preferred nonlimiting embodiment, latch 30 must be sufficiently rigid so as to maintain a grip about pivot 24 and sufficiently rigid along its length to maintain catch 38 in position to prevent opening of lid 14. However, latch 30 must be sufficiently flexible to allow flattening of latch 30 without the need for excessive force, i.e. not beyond a manual force easily applied by an ordinary person and to allow handle 36 sufficient movement to allow catch 38 to either be deflected by rim 22 or disengaged by rim 22. Latch 30 also exhibits restorative properties so that once released, latch 30 returns to its original shape. In the most preferred embodiment, latch 30 must maintain these properties across a temperature range from −30° C. to 30° C. In a preferred, but nonlimiting embodiment, latch 30 is unitary nylon construct.

A slit 35 is formed within pivot member 32. Slit 35 mates with a projection (not shown) formed on lid 14. Slit 35 is off centered along the axis of second member 32 which prevents mistaken installation of latch 30. Latch 30 will only fit about pivot 24 of lid 14 when slit 35 is aligned with the projection guaranteeing normal orientation.

It is to be understood that while certain forms of the present invention have been illustrated and described herein, the present invention is not to be limited to the specific forms or arrangement of parts described and shown.

What is claimed as new and desired to be protected by Letters Patent of the United States is:

1. A cart comprising:

a body;

a lid rotatably affixed to the body and moveable between a first position and a second position; and a plastic latch pivotally mounted on the lid for selectively locking the lid in a closed position, the latch having a first member adapted to be pivotally mounted to the lid; a second member adapted to selectively engage a projection on the housing; and an arched member connecting the first member to the second member, a plurality of support members extending along a concave surface of the arched member configured to provide some strength to the arch member, the arched member being deflected to lengthen the arched member to allow a catch on the second member to engage the projection when a force is applied to a convex surface of the arched member, wherein the first member pivots about an axis, and a slit is formed in the first member along said axis, off center of said first member, providing guiding means for correctly installing the plastic latch to the lid.

2. The cart of claim 1, wherein the catch extends from the second member, the catch being disposed along the second member at a position such that when no force is applied to the convex surface the catch is disposed so as not to engage the projection when adjacent the body, and when a sufficient force is applied to the convex surface, the catch is disposed to engage the projection.

3. The cart of claim 1, further comprising a pivot formed in the lid, the first member having a receiving portion for receiving the pivot therein.

4. The cart of claim 1, wherein the catch is formed with a camming surface.

5. The crate of claim 1, wherein said second member includes a handle, the handle formed with an arch, the arch extending in a direction opposite to a direction in which the arch member extends.

6. A plastic latch for selectively locking a lid to a cart body comprising a first member adapted to be pivotally mounted to a lid; a second member adapted to selectively engage a projection on a cart body; and an arched member connecting the first member to the second member, a plurality of support members extending along a concave surface of the arched member configured to provide some strength to the arched member, the arched member being deflected to allow a catch extending from the second member to engage the housing when a force is applied to a convex surface of the arched member, wherein the first member pivots about an axis, and a slit is formed in the first member along said axis off center of said first member providing guiding means for correctly installing the plastic latch.

7. The latch of claim 6, wherein the catch being disposed along the second member at a position such that when no force is applied to the convex surface, the catch does not engage the cart body and when a sufficient force is applied to the convex surface, the catch engages the cart body.

8. The latch of claim 6, further comprising a receiving portion for receiving a pivot therein.

9. The latch of claim 6, wherein said catch includes a camming surface thereon.

10. The latch of claim 6, wherein said second member includes a handle, the handle formed with an arch, the arch extending in a direction opposite to a direction in which the arch member extends.

* * * * *